US007938762B2

(12) United States Patent
Nishimura

(10) Patent No.: US 7,938,762 B2
(45) Date of Patent: May 10, 2011

(54) AUTOMATIC WEIGHT STACK CONTROLLER FOR FITNESS EQUIPMENT

(76) Inventor: Takashi Nishimura, Sao Pãulo (BR)

( * ) Notice: Subject to any disclaimer, the term of this patent is extended or adjusted under 35 U.S.C. 154(b) by 81 days.

(21) Appl. No.: 12/304,404

(22) PCT Filed: Nov. 10, 2006

(86) PCT No.: PCT/BR2006/000252

§ 371 (c)(1),
(2), (4) Date: Feb. 5, 2009

(87) PCT Pub. No.: WO2007/143802

PCT Pub. Date: Dec. 21, 2007

(65) Prior Publication Data

US 2009/0203500 A1 Aug. 13, 2009

(30) Foreign Application Priority Data

Jun. 14, 2006 (BR) ..... 0602697

(51) Int. Cl.
*A63B 21/008* (2006.01)
*A63B 21/005* (2006.01)
*A63B 21/062* (2006.01)

(52) U.S. Cl. ..... 482/111; 482/5; 482/98

(58) Field of Classification Search ..... 482/4, 5, 482/93, 97–103, 111, 112, 135
See application file for complete search history.

(56) References Cited

U.S. PATENT DOCUMENTS

| | | | | |
|---|---|---|---|---|
| 6,015,367 | A * | 1/2000 | Scaramucci | 482/5 |
| 6,117,049 | A * | 9/2000 | Lowe | 482/4 |
| 6,174,265 | B1 * | 1/2001 | Alessandri | 482/5 |
| 6,224,519 | B1 * | 5/2001 | Doolittle | 482/98 |
| 6,350,220 | B1 * | 2/2002 | Milburn et al. | 482/98 |
| 6,632,161 | B1 * | 10/2003 | Nir | 482/98 |
| 7,060,010 | B2 * | 6/2006 | Daniel | 482/94 |
| 7,614,981 | B2 * | 11/2009 | Cao | 482/98 |
| 2002/0025888 | A1 * | 2/2002 | Germanton et al. | 482/1 |

* cited by examiner

*Primary Examiner* — Allana Lewin
(74) *Attorney, Agent, or Firm* — Arent Fox LLP

(57) ABSTRACT

An automatic weight stack controller for fitness units adapted to a frame provided with weights piled up is disclosed, wherein the weights are provided with central vertical holes having inner circular grooves and a tube fit into said central holes, said tube being provided with radial holes disposed at the level of each weight wherein balls are housed, so that said balls can be pushed towards the grooves by a piston that slides vertically inside the tube, having conical ends and threaded on a vertical threaded bar centrally to the tube, where there is an eyelet for the steel cable designed to raise the weights, the selection of weights being carried out through a panel of instruments, with a digital display, and buttons to increase or decrease the number of weights.

10 Claims, 6 Drawing Sheets

-- PRIOR ART --

-- PRIOR ART --

AUTOMATIC WEIGHT STACK CONTROLLER FOR FITNESS EQUIPMENT

BACKGROUND

The present specification is related to an automatic weight stack controller for fitness equipment.

Every fitness equipment is provided with a frame in common, on the base of which weights are stacked around vertical guides, which weights can be raised by means of a central cable, pivoted on a pulley on top of the frame. All the weights have a vertical hole in the center thereof, and the central cable is attached to a vertical rod that passes through the holes of all the weights. At the middle level of each of the weights, said rod is provided with a transversal hole that matches with a transversal hole in each weight, and both holes are co-linear in their resting condition. A bolt is introduced in the hole of the corresponding weight at the desired load, and passes through the corresponding hole of the rod. While a fitness exercise is being carried out, the rod is raised by the cable, the bolt raises both the weight where it is fit and all the remaining weights that are supported thereon. In this condition, the bolt makes it possible to determine the number of weights that will be raised and, therefore, the load that is suited to the exercise and the user is selected.

In many fitness units with their levers, bar bells, seats and backrests, the frame together with its weights would be in such a position that the user would not have to raise his supported body to reach the load selecting bolt and change the load. To this aim, the units should be provided with a large number of pulleys so that the pathway of the cable can suit both the unit and the special position of the frame.

The rising movement of the weights can be dangerous in the event the feet, hands, or fingers are caught between the heavy weights and the other ones.

The frames are then coated on their contour, all over their height, however, there should be a gap where the selecting bolt can be located in the selected weight.

SUMMARY

The purpose of the present patent application is to simplify the action of selecting weights, in order to allow the frame to be positioned in a suitable place to achieve the best mechanical solution, without depending on the distance the user can reach, and also allowing the use of a fully closed frame.

BRIEF DESCRIPTION OF THE DRAWINGS

The present invention will be described below with reference to the accompanying drawings, in which.

DETAILED DESCRIPTION

Figure 1:
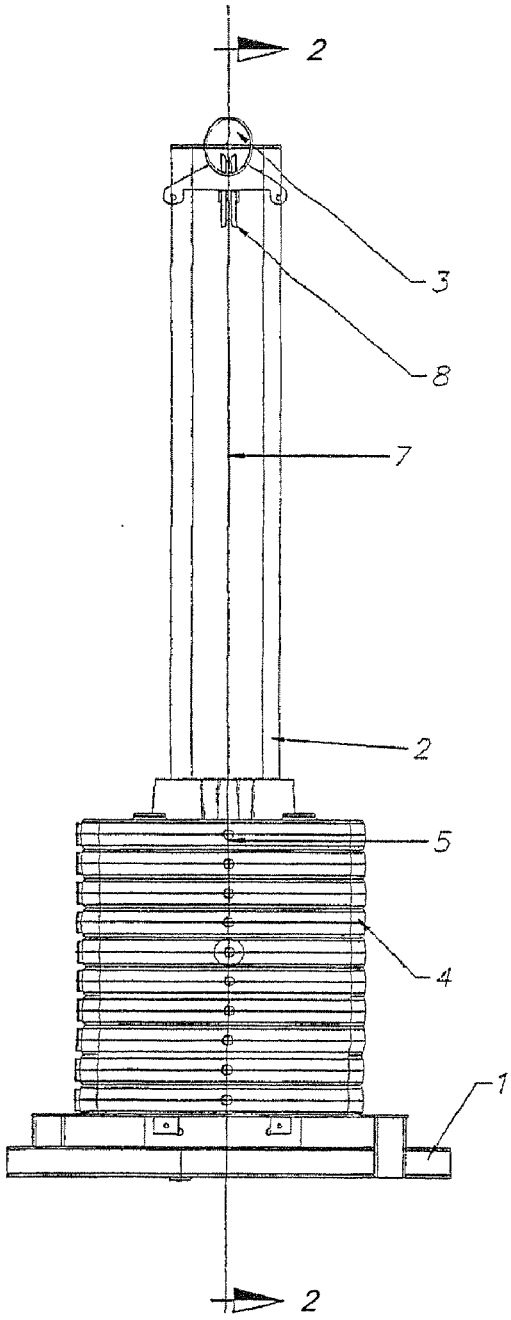
FIG. 1 represents an elevational view of a conventional frame.

In accordance with these illustrations, the stack of weights for fitness equipment utilized in the present invention is comprised of a frame that usually comprises a base (1) with two upright columns (2) and a top (3), making out a rigid assembly, as can be seen in FIG. 1.

Several thick-plate shaped weights (4) are piled up on the base (1) and are provided with holes that the columns (2) pass through. Centrally, the weights (4) are provided with vertical holes and horizontal holes (5), perpendicular to the central holes and half way of the height of each weight.

A vertical rod (6) passes through the central vertical holes of the weights and have radial holes disposed at the levels of the horizontal holes (5) of the weights.

Figure 2:
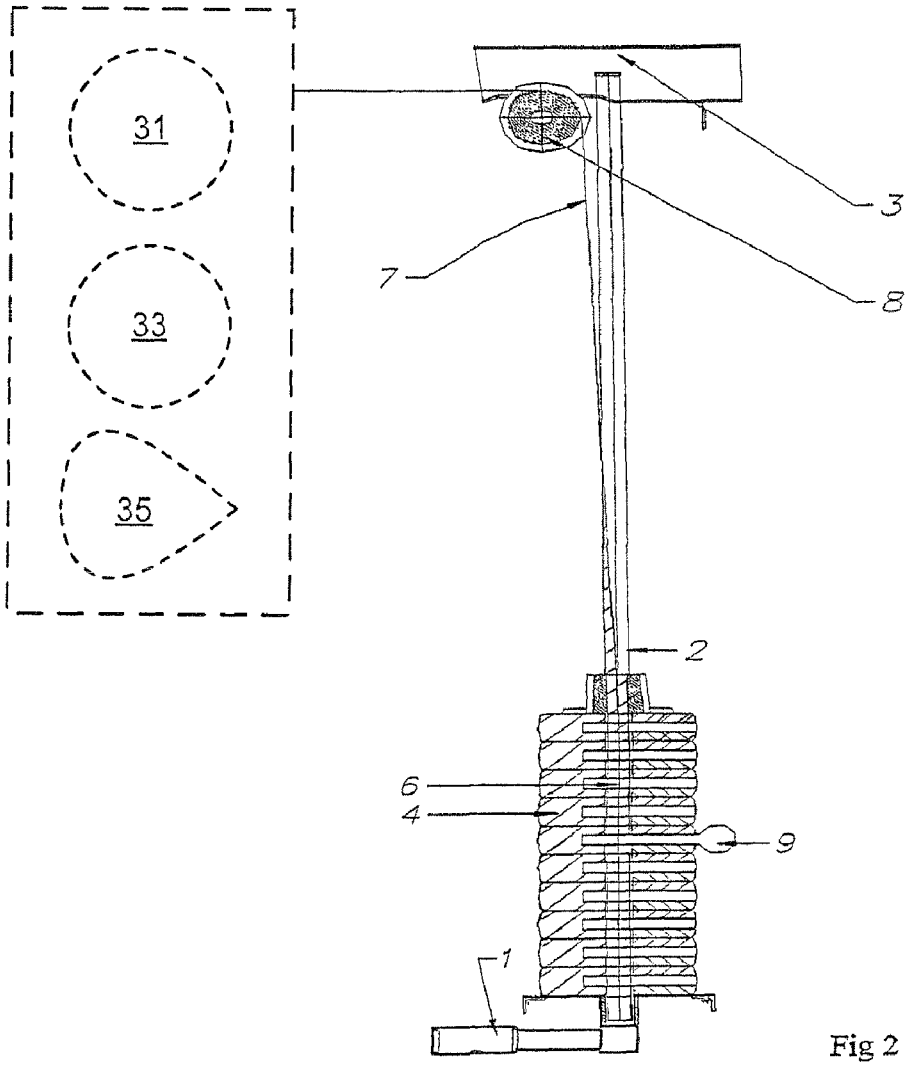
FIG. 2 represents a vertical cut of the conventional frame along line 2-2 of FIG. 1.

FIG. 2 shows that the steel cable (7) is attached to the upper part of the rod (6) that is disposed vertically, and that on top (3) in the upper part of the frame it is deviated by a pulley (8), and runs outwards the frame, where it runs on several pulleys 31, 33 until it reaches the point in the station where it will be connected with a lever or another means 35, such as one or more cams, for transmitting the muscular force to the cable. A bolt (9), provided with a cable for handling same, is inserted into a hole (5) of one of the weights (4), passing through one of the radial holes of the rod (6).

By tensioning the cable (7), the rod (6) raises—by means of the bolt (9)—the weight that is crossed by same, and also all the weights above same. This conventional construction is represented in FIGS. 1 and 2, and has been used for many years by almost all the manufacturers of fitness units that use weights.

The present invention is presented in FIGS. 3, 4, 5 and 6 and refers to a new conception for a weight selecting device in a frame.

Since the conventional frame shown in FIGS. 1 and 2 that is comprised of a base (1), upright columns (2) and a top (3), with its weights (4) piled up, and a steel cable (7) is used in the new mechanism, its numbers match the ones of the components, thus evidencing the fact that they are of public domain.

Neither the horizontal holes (5) of the weights (4), nor the central vertical rod (6), nor the bolt (9) for selecting weights are used in the present invention.

Figure 3:
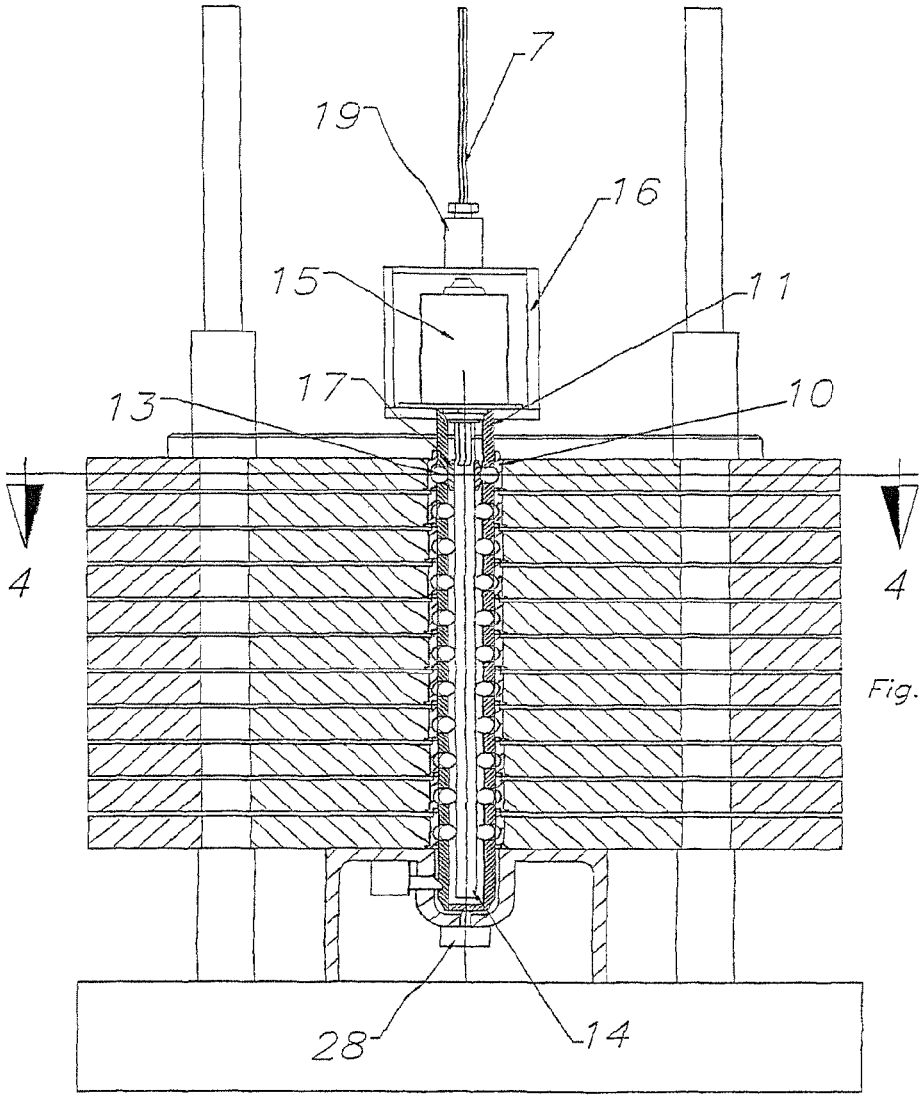
FIG. 3 represents a vertical cut of a frame provided with the mechanism object of the present invention.
Figure 3A:
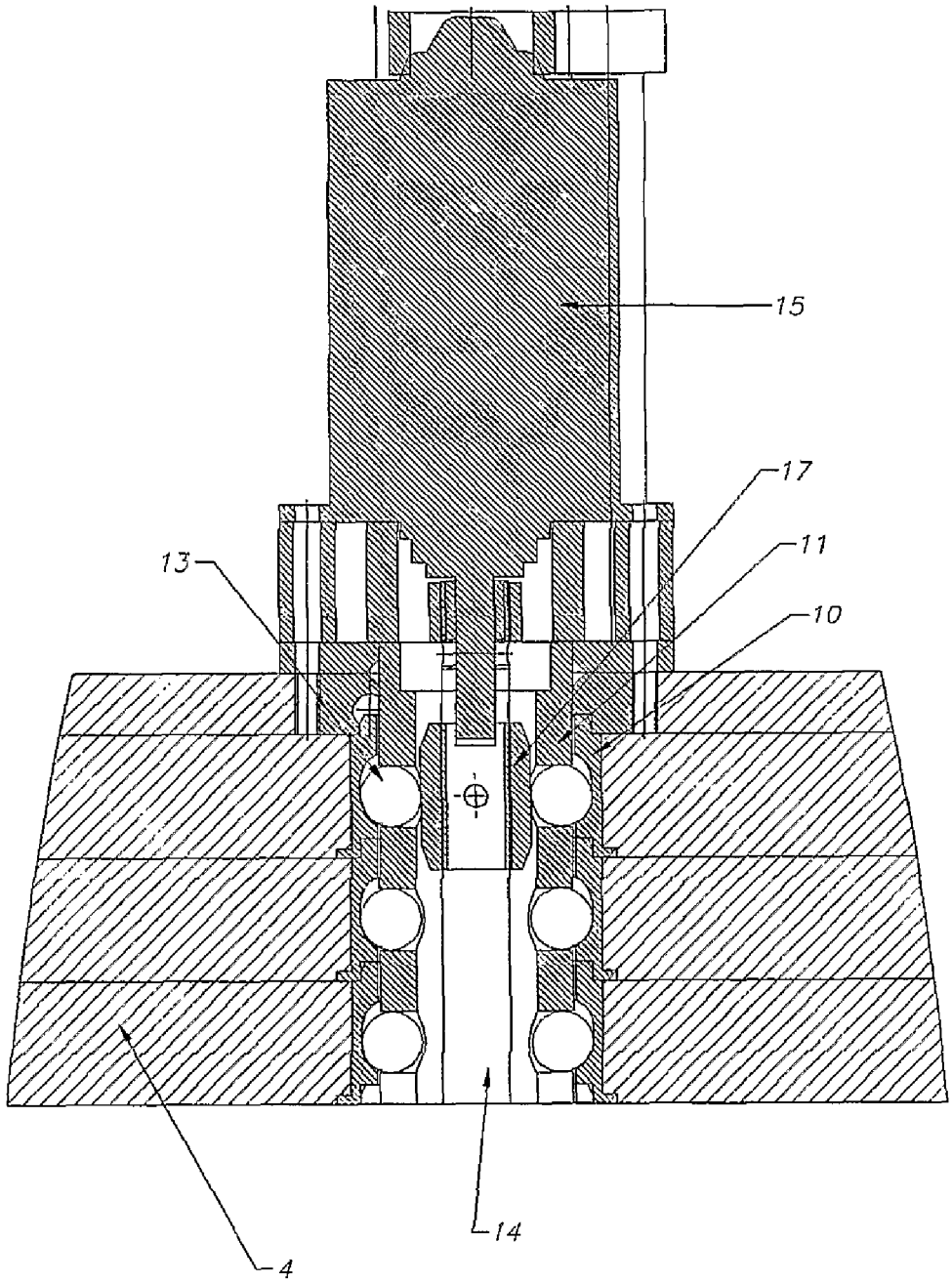
FIG. 3*a* represents a vertical cut of a portion of the frame of FIG. 3.
Figure 4:
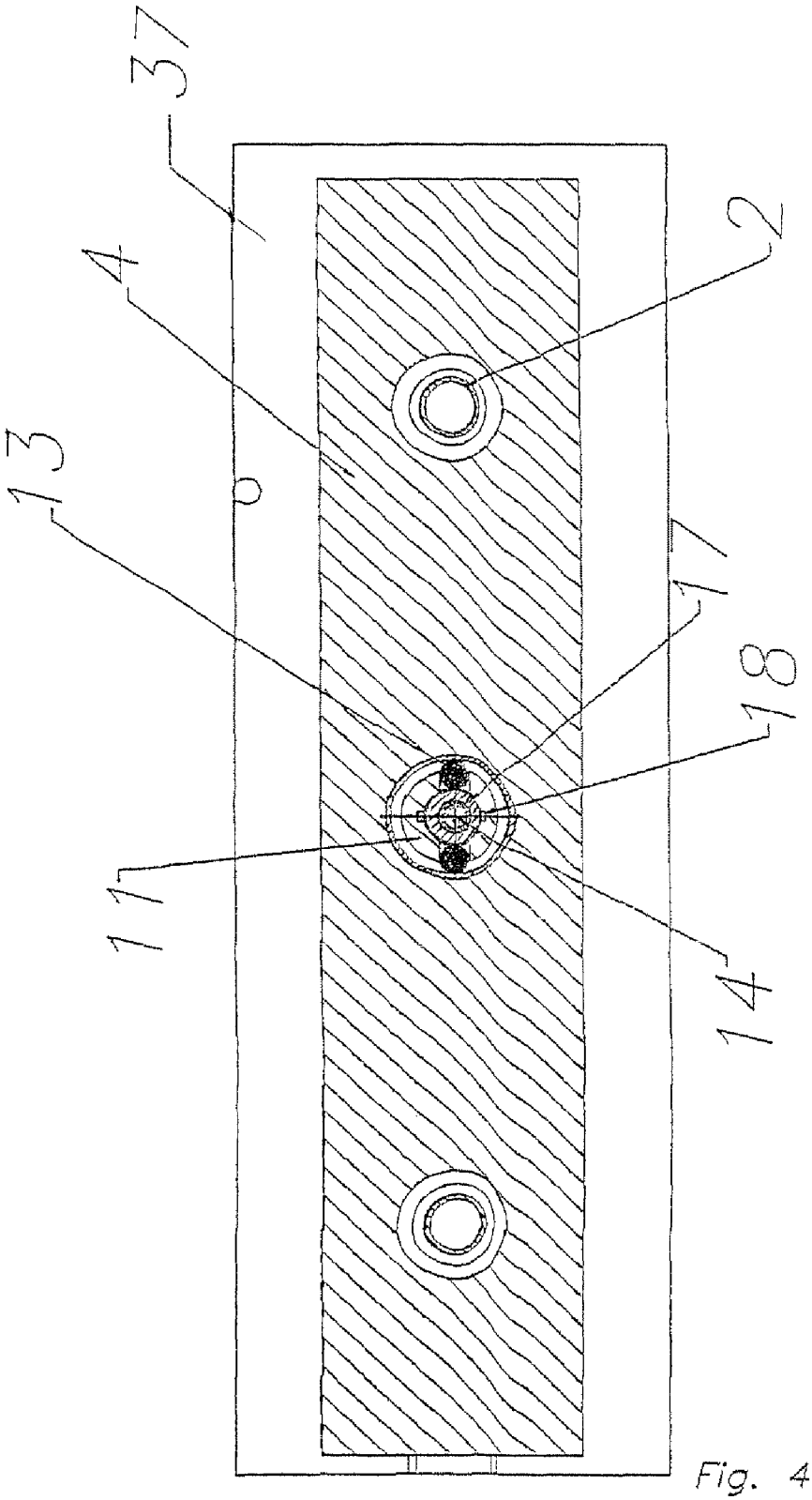
FIG. 4 represents a horizontal cut along line 4-4 in FIG. 3 of the frame provided with the mechanism object of the invention, at the center level of one of the weights.
Figure 5:
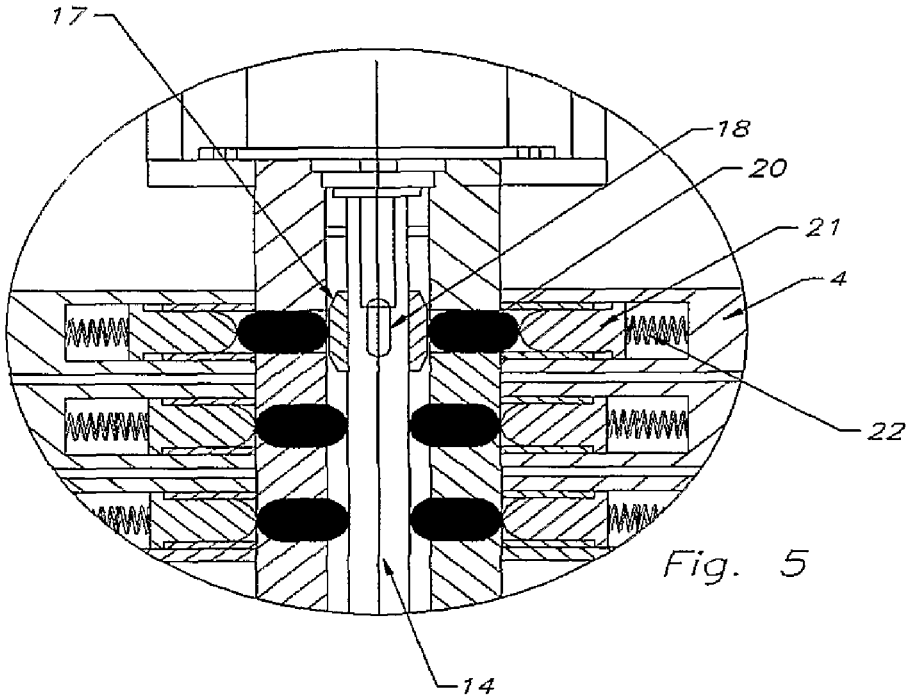
FIG. 5 represents a vertical cross section of a central length of an improved frame, encompassing two of the weights, and with a mechanism that optionally uses radial bolts.

FIGS. 3, 4 and 5 show cut views of the new mechanism for selecting weights, for the sake of clarity of the details.

Each weight (4) is provided with a central vertical hole that has a "V" section or half-moon shaped circular groove (10) similar to the external ring of a ball bearing, located half way of the height of the weight.

Tightly inserted in the central hole of the weights is a tube (11), in the walls of which, there are radial holes (12) at the level of each groove (10), where balls (13) are tightly fit into. In its whole extension, centrally to the tube (11), is located a threaded rod (14) that goes past a bearing on top of the tube (11) and is attached to the axle of an electric engine (15) that is also placed vertically, the carcass of which is attached to a housing (16) of the tube (11).

A piston (17) of a basic cylindrical shape with two conical ends is innerly threaded and is attached to the rod (14), the diameter of which is slightly less than the external diameter of the tube (11), where it is housed, and its height is such that it can contact only the balls disposed at the same level. So that the piston (17) does not turn when the rod (14) rotates, it is provided with keys (18) that fit into the vertical grooves of the tube (11). In this condition, when the rod (14) rotates, the piston can go up or down.

When the cylindrical part of the piston is disposed at the level of the balls (13), they are pushed outwards, thus getting into the grooves (10) of the weight (4) selected that will be attached to the tube (11), so that the remaining weights are not attached to the tube, since the balls thereof retreat towards the rod (14). However, if the tube (11) is raised by the steel cable (7) by means of an eyelet (19) or any other attachment means, for the sake of support, all the weights above the one selected will be raised.

In FIG. 5, within the same scope of the invention, bolts (20) can be fit into the holes of the tube (11), so that the weights (4) are provided with another bolt (21) that is in turn provided with a spring (22) in the direction of each bolt (20) to make same return to a position wherein the tube can be moved vertically. This construction requires the holes to be aligned and, therefore, a groove and vertical keys should be provided between the tube (11) and the weights (4).

In order to actuate the weight stack, conventional electronic means that are driven by an electric engine can be used in the exact number of turns that locate the piston (17) in the desired weight with a great precision. The driving can be carried out by a panel (23) provided with a digital display (24) of the weight selected, plus "more" (25) and "less" (26) buttons for the changes.

So that the change can never be made without the weights having been supported on the base (1) of the frame, a microswitch (28) assembled on this base allows the electric engine (15) to move when it "feels" the presence of the lower part of the tube (11). Thus, besides preventing the eventual fall of the suspended weight, it is then possible to actuate the mechanism practically without any load.

Figure 6:
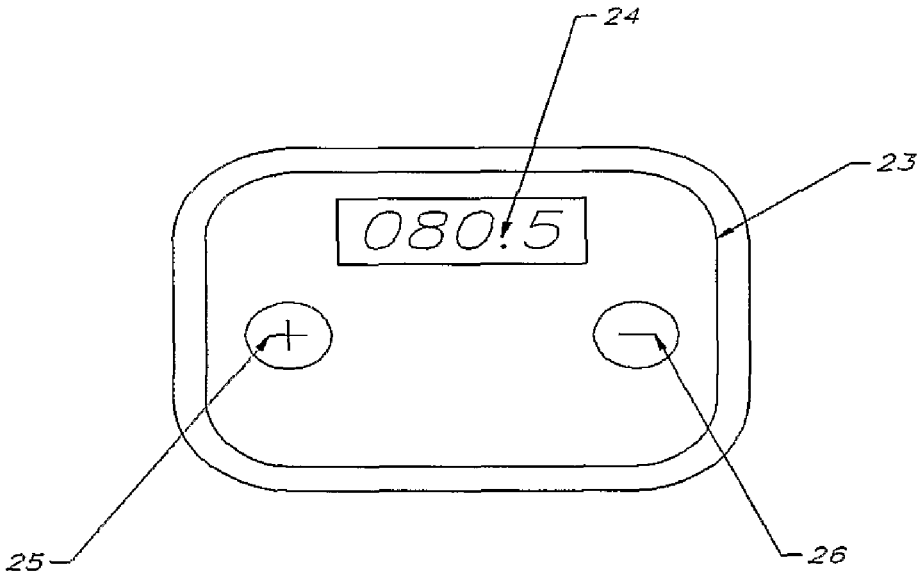
FIG. 6 represents a plan view of a selecting panel of the mechanism driving unit of the invention.

The panel (23)—see FIG. 6—can be located in a place wherein the user of the unit can most easily access same. The frame, since it does not need the manual intervention of the user, can be fully closed, and located in a place that is more suited to the minimization of pulleys used for deviating cables.

The electronic portion can also foresee a solenoid latch that keeps the weights and the tube (11) on the base (1) until it is unlocked when the piston (17) is positioned at the selected level.

The fitness unit provided with the mechanism of the present invention provides the user with a greater comfort, since the selection of weights is then carried out with the simple touch of a finger on an easy-to-access panel.

The frame comprised of the base (1), columns (2) and top (3) in the present invention is fully closed, and the vertical walls 37 (FIG. 4) thereof are very close to the contour faces of the weights. In this condition, the vertical movement of one weight (4) or a group of weights acts as a pneumatic piston with controlled air leak. Therefore, any vertical sudden movements are dampened.

A too fast downward movement of the weights suspended on weights resting on the base (1) end up in the gradual compression of the air contained therebetween, thus attenuating eventual undesirable impacts and noises.

The invention claimed is:

1. An automatic weight stack controller for fitness equipment, comprising:

a frame having a base, upright columns, and an upper top;

a cable for raising a stack of weights or a selected part thereof disposed in the frame, wherein said stack of weights are comprised of plates guided by the columns;

a vertical hole disposed in each weight of the stack of weights;

a "V" section or partially circular groove defined within the vertical hole of each weight of the stack of weights;

a vertical tube having radial holes level with each one of the grooves, wherein a plurality of balls are disposed in the radial holes;

a threaded rod disposed within the vertical tube and attached to an axle of an electric engine; and a piston having a cylindrical shape and conical ends attached to the threaded rod;

wherein an external diameter of the piston is less than an inner diameter of the vertical tube;

wherein a wall thickness of said vertical tube is less than the diameter of the balls, such that the balls that are level with the piston fit into the groove of a weight of the stack of weights that is level with the piston; and wherein the vertical tube is attached to the cable.

2. The automatic weight stack controller for fitness equipment according to claim 1, wherein the piston is provided with keys on the sides thereof that slidably fit into vertical grooves located in an inner wall of the tube.

3. The automatic weight stack controller for fitness equipment according to claim 1, wherein the electric engine is actuated by a panel having a digital display of the weight selected, the digital display including at least two buttons for changing a selected amount of weight, and wherein the base of the frame is provided with a microswitch that is actuated by a base of the vertical tube when it reaches the lowest level, and wherein the microswitch inhibits the weight selection any time the tube is raised, and actuates a latch that attaches the vertical tube to the base until the weight selection is completed.

4. The automatic weight stack controller for fitness equipment according to claim 1, further comprising protection walls that contour vertically and enclose the stack of weights from the base to the top, the protection walls having inner faces adjacent to contours of the weights such that the protection walls act as pneumatic pistons with controlled air leak, thereby attenuating sudden vertical movements as well as dampening impacts between adjacent weights of the stack of weights during a downward movement.

5. The automatic weight stack controller for fitness equipment according to claim 1, further comprising at least one of a lever, a pulley or a cam, wherein said cable is tensioned by the at least one of the lever, the pulley or the cam.

6. An automatic weight stack controller for fitness equipment comprising:

a frame having a base, upright columns, and an upper top;

a cable for raising a stack of weights or a selected part thereof disposed in the frame, wherein said stack of weights are comprised of plates guided by the columns;

a vertical hole disposed in each weight of the stack of weights;

an elongated groove defined within the vertical hole of each weight of the stack of weights and extending horizontally into each weight, wherein a spring biased bolt is disposed in the elongated groove;

a vertical tube having radial holes level with each one of the elongated grooves, wherein a plurality of bolts are disposed in the radial holes;

a threaded rod disposed within the vertical tube and attached to an axle of an electric engine; and a piston having a cylindrical shape and conical ends attached to the threaded rod;

wherein an external diameter of the piston is less than an inner diameter of the vertical tube;

wherein a wall thickness of said vertical tube is less than a length of each of the plurality of bolts, such that the respective ones of the plurality of bolts that are level with the piston fit into the elongated groove of a weight of the stack of weights that is level with the piston; and wherein the vertical tube is attached to the cable.

7. The automatic weight stack controller for fitness equipment according to claim 6, wherein the electric engine is actuated by a panel having a digital display of the weight selected, the digital display including at least two buttons for changing a selected amount of weight, and wherein the base of the frame is provided with a microswitch that is actuated by a base of the vertical tube when it reaches the lowest level, and wherein the microswitch inhibits the weight selection any time the tube is raised, and actuates a latch that attaches the vertical tube to the base until the weight selection is completed.

8. The automatic weight stack controller for fitness equipment according to claim 6, further comprising protection walls that contour vertically and enclose the stack of weights from the base to the top, the protection walls having inner faces to the adjacent to contours of the weights such that the protection walls act as pneumatic pistons with controlled air leak, thereby attenuating sudden vertical movements as well as dampening impacts between adjacent weights of the stack of weights during a downward movement.

9. The automatic weight stack controller for fitness equipment according to claim 6, wherein the piston is provided with keys on the sides thereof that slidably fit into vertical grooves located in an inner wall of the tube.

10. The automatic weight stack controller for fitness equipment according to claim 6, further comprising at least one of a lever, a pulley or a cam, wherein said cable is tensioned by the at least one of the lever, the pulley or the cam.

* * * * *